US010465856B2

(12) United States Patent
Beijer

(10) Patent No.: US 10,465,856 B2
(45) Date of Patent: Nov. 5, 2019

(54) LIGHTING DEVICE WITH A FLEXIBLE CIRCUIT STRIP WRAPPED AROUND A SUPPORT

(71) Applicant: SIGNIFY HOLDING B.V., Eindhoven (NL)

(72) Inventor: Johannes Gerrit Jan Beijer, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/755,163

(22) PCT Filed: Aug. 25, 2016

(86) PCT No.: PCT/EP2016/070110

§ 371 (c)(1),
(2) Date: Feb. 26, 2018

(87) PCT Pub. No.: WO2017/036924

PCT Pub. Date: Mar. 9, 2017

(65) Prior Publication Data

US 2018/0245743 A1 Aug. 30, 2018

(30) Foreign Application Priority Data

Sep. 4, 2015 (EP) ..... 15183800

(51) Int. Cl.

| | |
|---|---|
| ***F21K 9/232*** | (2016.01) |
| ***F21V 23/06*** | (2006.01) |
| ***F21K 9/23*** | (2016.01) |
| ***F21V 29/83*** | (2015.01) |
| *F21K 9/66* | (2016.01) |

(Continued)

(52) U.S. Cl.

CPC ..... *F21K 9/232* (2016.08); *F21K 9/23* (2016.08); *F21V 23/06* (2013.01); *F21V 29/83* (2015.01); *F21K 9/66* (2016.08); *F21Y 2103/10* (2016.08); *F21Y 2107/30* (2016.08); *F21Y 2107/40* (2016.08); *F21Y 2115/10* (2016.08); *F21Y 2115/15* (2016.08); *F21Y 2115/30* (2016.08)

(58) Field of Classification Search

None

See application file for complete search history.

(56) References Cited

U.S. PATENT DOCUMENTS

| | | | | |
|---|---|---|---|---|
| 8,545,056 | B2 * | 10/2013 | Kajiya | H05K 1/147 362/249.04 |
| 2013/0271990 | A1 | 10/2013 | Hussell et al. | |
| 2014/0268740 | A1 * | 9/2014 | Veres | H01L 33/54 362/235 |

FOREIGN PATENT DOCUMENTS

| | | | |
|---|---|---|---|
| CN | 203442690 | U | 2/2014 |
| CN | 103775983 | A | 5/2014 |

(Continued)

*Primary Examiner* — Sharon E Payne

(74) *Attorney, Agent, or Firm* — Akarsh P. Belagodu

(57) ABSTRACT

A lighting device is disclosed. The lighting device comprises a light transmitting housing and a solid state light source carrier (1) arranged inside the housing. The carrier (1) includes a cylindrical support (2), which has two polygon base surfaces (2*a*, 2*b*) and a number of side surfaces (2*c*), and a flexible circuit strip (3) which has several solid state light sources (4) mounted thereon. The strip (3) is wrapped around the cylindrical support (2) so that the strip (3) extends at least once across each base surface (2*a*, 2*b*). A method for producing a lighting device is also disclosed.

9 Claims, 5 Drawing Sheets

(51) Int. Cl.

| | |
|---|---|
| *F21Y 103/10* | (2016.01) |
| *F21Y 115/10* | (2016.01) |
| *F21Y 107/40* | (2016.01) |
| *F21Y 107/30* | (2016.01) |
| *F21Y 115/30* | (2016.01) |
| *F21Y 115/15* | (2016.01) |

(56) References Cited

FOREIGN PATENT DOCUMENTS

| | | | |
|---|---|---|---|
| JP | 2011249534 | A | 12/2011 |
| WO | WO200017569 | A1 | 3/2000 |
| WO | WO200217690 | A1 | 2/2002 |

* cited by examiner

LIGHTING DEVICE WITH A FLEXIBLE CIRCUIT STRIP WRAPPED AROUND A SUPPORT

CROSS-REFERENCE TO PRIOR APPLICATIONS

This application is the U.S. National Phase application under 35 U.S.C. § 371 of International Application No. PCT/EP2016/070110, filed on Aug. 25, 2016, which claims the benefit of European Patent Application No. 15183800.0, filed on Sep. 4, 2016. These applications are hereby incorporated by reference herein.

TECHNICAL FIELD

The present invention relates to a lighting device based on solid state lighting (SSL) technology.

BACKGROUND

There is currently a strong trend to replace incandescent lighting devices with lighting devices based on SSL technology for reasons of energy efficiency and operational lifetime. An example of an SSL type lighting device is the lamp disclosed in CN103775983A. This lamp has light emitting diodes (LEDs) mounted on a cylindrical substrate comprising several side plates and a top plate.

Despite the efforts that have gone into developing lighting devices based on SSL technology, further efforts aimed at finding innovative solutions to the various technical challenges associated with the development of such lighting devices are warranted. For example, a pertinent problem is how to achieve a uniform light distribution without having to resort to complicated designs that add significant costs to the manufacturing process.

SUMMARY

The general objective of the present invention is to provide an improved or alternative lighting device based on SSL technology. Specific objectives include a high degree of light distribution uniformity, low manufacturing costs and easy manufacturing.

According to one embodiment, there is provided a lighting device that comprises a light transmitting housing and a solid state light source carrier arranged inside the housing. The carrier includes a cylindrical support, which has two polygon base surfaces and a number of side surfaces, and a flexible circuit strip on which several solid state light sources are mounted. The strip is wrapped around the support so that the strip extends at least once across each base surface.

The invention is based on the realization that the combined use of a flexible circuit strip and a polygonal cylinder as support makes it possible to simultaneously meet several quite separate technical requirements. The polygonal shape allows for a flexible strip to be securely wrapped around the cylindrical support in such a way that the light sources emit light in many spatial directions so that a uniform light distribution is achieved. Wrapping the strip around the cylindrical support can be done by a fast process requiring but a few simple steps. Also, flexible circuit strips can be produced by inexpensive methods, such as roll-to-roll processing, and this helps to keep the costs for manufacturing the lighting device low.

The cylindrical support is typically a right cylinder and may be a right prism. The base surfaces are typically convex polygons and may be regular polygons. It should be noted that the side and base surfaces can be "open" or "closed". By a closed surface is meant an actual, physical surface, and by an open surface is meant an imaginary, purely geometrical surface. An open surface may be defined by, for example, a frame that defines the boundaries of the surface or by a mesh structure. A gas can flow through an open surface but not through a closed surface.

Having at least one of the base surfaces open so as to allow a flow of gas therethrough may help to improve the cooling of the lighting device by making it possible for convection currents to flow through the cylindrical support. A frame or mesh structure of the support, having all side surfaces and base surfaces open, may allow for a particularly efficient convective heat transfer from the flexible circuit strip.

According to one embodiment, the strip extends across each side surface. This allows for light to be emitted in many directions, something which increases the uniformity of the light distribution.

According to one embodiment, the strip extends across each side surface only once. This allows for light to be emitted in many directions without the strip being longer than necessary. The cost of materials can thus be kept low without sacrificing the technical performance of the lighting device.

According to one embodiment, at least one solid state light source is mounted on the strip on each side surface. This is a simple way of making sure that light is emitted in many directions. The number of solid state light sources mounted on the strip on each side surface may easily be varied, and it is thus straightforward to optimize the light intensity of the lighting device for the intended application.

According to one embodiment, the lighting device further comprises a connector for mechanically and electrically connecting the lighting device. At least one solid state light source is mounted on the strip on a base surface facing away from the connector. It is straightforward to make sure that light is emitted perpendicularly to the side surfaces by arranging light sources by one, or both, of the base surfaces. By doing so, the "dark spot" at the top of the lighting device can be reduced.

According to one embodiment, the number of side surfaces is seven and a ratio between a height of the cylindrical support to a radius of the base surfaces is less than 3.5. Seven side surfaces may be suitable where a tall and narrow cylindrical support is required, for example to meet certain space constraints inside the lighting device.

According to one embodiment, the number of side surfaces is eight and a ratio between a height of the cylindrical support to a radius of the base surfaces is less than 2. Eight side surfaces may be suitable where a small and wide cylindrical support is required.

According to one embodiment, the number of side surfaces is nine and a ratio between a height of the cylindrical support to a radius of the base surfaces is less than 3. One way to have the lighting device generate light that is uniformly distributed is to use a cylindrical support that has a large number of side surfaces, and nine side surfaces results in a light distribution that is sufficiently uniform for most applications.

According to a second aspect, a method for producing a lighting device is provided. The method comprises providing a cylindrical support, which has two polygon base surfaces and a number of side surfaces, and wrapping a flexible circuit strip around the support. Several solid state light sources are mounted on the strip. Wrapping the strip around the cylindrical support includes rotating the cylindrical support about a first axis, which is perpendicular to the base surfaces, and about a second axis which is perpendicular to the first axis. The effects and features of the second aspect are similar to those of the first aspect. It is noted that the invention relates to all possible combinations of features recited in the claims.

DETAILED DESCRIPTION

Figure 1:
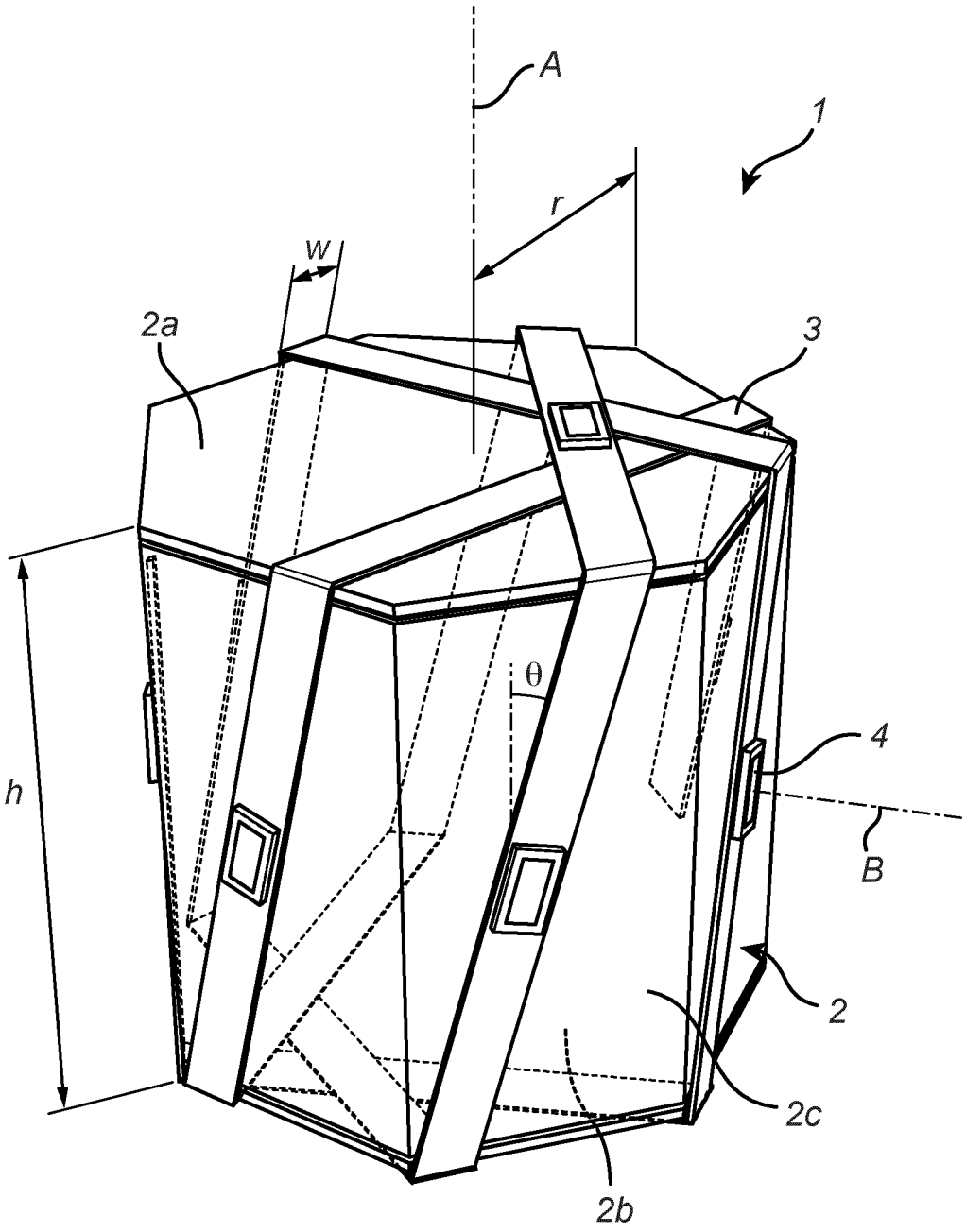
FIG. 1 is a schematic perspective view of a solid state light source carrier.

FIG. 1 shows an example of a solid state light source carrier 1 (henceforth referred to as the "carrier" for brevity). The carrier 1 includes a cylindrical support 2 that has two base surfaces 2*a*, 2*b* and a number of side surfaces 2*c*. The cylindrical support 2 is made of a flat piece of metal that has been cut and folded into a cylindrical shape. The base surfaces 2*a*, 2*b* and the side surfaces 2*c* are all closed, but this may not be the case in other embodiments. For example, the base surfaces 2*a*, 2*b* and the side surfaces 2*c* may be open and closed, respectively, or the base surfaces 2*a*, 2*b* and the side surfaces 2*c* can all be open.

The two base surfaces 2*a*, 2*b* have the same shape and size. More precisely, the base surfaces 2*a*, 2*b* are convex polygons with seven sides. The polygons are regular polygons, i.e. all the sides have the same length and the angles between adjacent sides are all equal in measure. The number of sides of the base surfaces 2*a*, 2*b* may be different from seven in other embodiments. For example, the number of sides may be three, four, five, seven, eight, nine or eleven. The number of sides of the base surfaces 2*a*, 2*b* may be a number N such that N is relatively prime to (N−1)/2 rounded down to the nearest integer.

The side surfaces 2*c* are rectangular, all of them having the same shape and size. The number of side surfaces 2*c* is equal to the number of sides of the base surfaces 2*a*, 2*b*, so the number of side surfaces 2*c* is seven in this embodiment. In other embodiments, the number of side surface 2*c* may for example be three, four, five, seven, eight, nine or eleven. The number of side surfaces 5*c* may be a number N such that N is relatively prime to (N−1)/2 rounded down to the nearest integer. The side surfaces 2*c* may be referred to as lateral surfaces or lateral faces of the cylindrical support 2.

A flexible circuit strip 3 (henceforth referred to as the "strip" for brevity) is wrapped around the cylindrical support 2. The strip 3 follows the contour of the cylindrical support 3 and has no cuts, loops or wrinkles. The strip 3 is wrapped around the cylindrical support 2 so that the strip 3 extends once across once each side surface 2*c*. The strip 3 may in other embodiments be wrapped so as to extend two times or more across each side surface 2*c* if the width of the strip 3 and the size of the cylindrical support 2 so permit. Assuming that there are N side surfaces 2*c* that are consecutively numbered from 1 to N (in the illustrated example N equals 7), the strip 3 extends from side surface number M, across one of the base surfaces 2*a*, 2*b*, to side surface number M+(N−1)/2 rounded down to the nearest integer. Of course, the number of a side surface 2*a*, 2*b* is calculated modulo N. Differently stated, the strip 3 goes from one side of a base surface polygon to the side next to the opposite side when the number of polygon sides is even and to a "nearly" opposite side when the number of polygon sides is odd. Wrapping the strip 3 in this way makes it possible to have a tall cylindrical support 2.

The strip 3 is tilted in the sense that the strip 3 makes an angle θ with a border of each side surface 2*c*. The value of the angle θ depends on the width w of the strip 3, the height h of the cylindrical support 2 and the radius r of the base surfaces 2*a*, 2*b*. The radius r is here defined as the distance from the center of a base surface 2*a*, 2*b* to a corner where two polygon sides meet. As will be further discussed below in connection with FIGS. 2 to 4 certain restrictions may apply to the values of the height h, the radius r and the width w.

The strip 3 may be wrapped around the cylindrical support 2 by attaching a first end of the strip 3 to one of the side surfaces 2*c*, rotating the cylindrical support 2 about a first axis A and a second axis B, and attaching a second end of the strip 3 to another side surface 2*c*. The first axis A is here the central longitudinal axis of the cylindrical support 2 and perpendicular to the base surfaces 2*a*, 2*b*. The second axis B is here perpendicular to the first axis A. Wrapping the strip 3 can then be accomplished by rotating the cylindrical support 2 several turns around the second axis B while slowly turning the cylindrical support 2 around the first axis A. Note that the second axis B remains fixed during rotation around the first axis A.

The strip 3 is configured to electrically connect several solid state light sources 4 (henceforth referred to as the "light sources" for brevity) which are mounted on the strip 3. The strip 3 may for example comprise a flexible plastic substrate on which a conductive pattern has been printed. The light sources 4 may for example be semiconductor LEDs, organic LEDs, polymer LEDs, or laser diodes. All of the light sources 4 may be configured to emit light of the same color, for example white light, or different light sources 4 may be configured to emit light of different colors. The light sources 4 are mounted on the strip 3 so that there is one light source 4 by each of the base surfaces 2*a*, 2*b* and one light source 4 by each of the side surfaces 2*c*. The light sources 4 may of course be mounted in many other ways depending on the light distribution requirements of the intended application. For example, there may be two or more light sources 4 by some or all of the base surfaces 2*a*, 2*b* and the side surfaces 2*c*.

Figure 2:
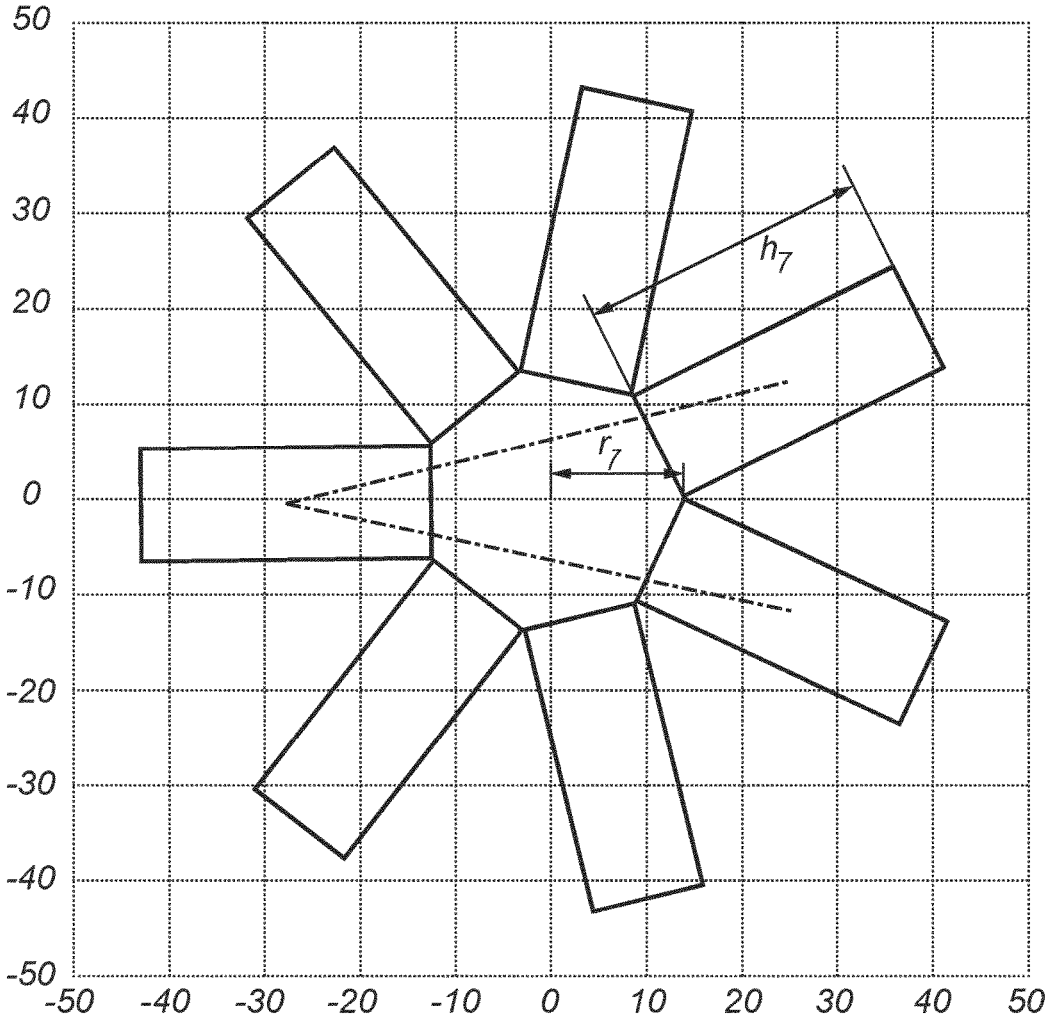
FIGS. 2 to 4 show regular polygons with rectangles extending from the polygon sides.
Figure 3:
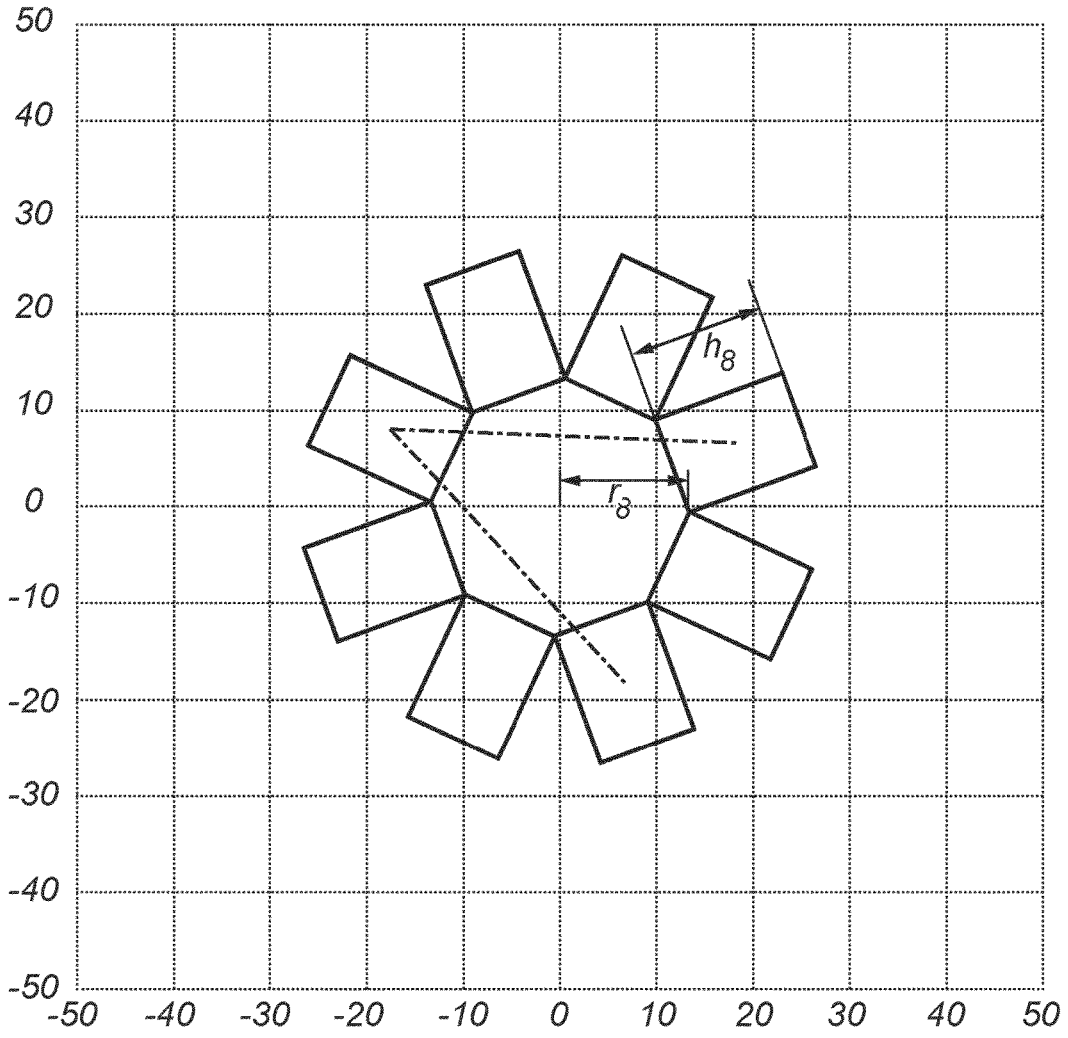
Figure 4:
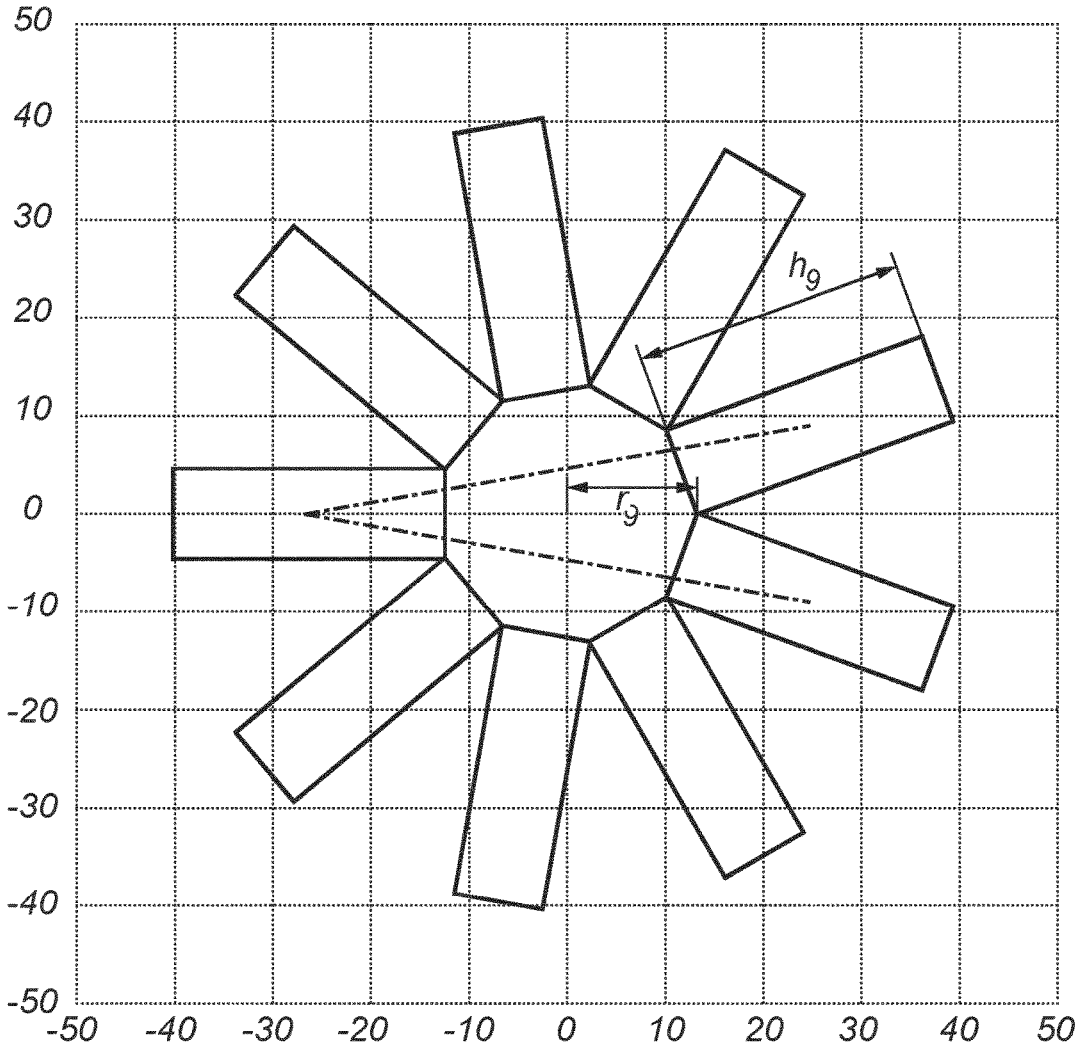

With reference to FIGS. 2 to 4, and with continued reference to FIG. 1, certain restrictions that may apply to the height h and the radius r of the cylindrical support 2 will be discussed. The polygons in FIGS. 2, 3 and 4 have seven, eight and nine sides, respectively. Each polygon has a radius denoted by an r with a subscript, the radius of a polygon here being defined as the distance between the centre of the polygon and a corner where two polygon sides meet. All the rectangles in one and the same figure are equal and their length is denoted by an h with a subscript.

An advantageous way of wrapping the strip 3 around the cylindrical support 2 is to have the strip 3 pass over the centres of the side surfaces 2*c*. In order for this to be possible without the strip 3 ending up folded over the polygon corners, the height h of the cylindrical support 2 should be below a threshold value for a given radius r of the base surfaces 2*a*, 2*b* and for a given width w of the strip 3. This is illustrated in FIGS. 2 to 4 from which it is clear that, if the lengths $h_7$, $h_8$, $h_9$ are increased while the radii $r_7$, $r_8$, $r_9$ are unchanged, the broken lines approach, and eventually touch, the corners where two polygons sides meet. The broken lines go from the centre of one rectangle to the centre of a "nearly" opposite rectangle in FIGS. 2 and 4 and to a rectangle that is next to the opposite rectangle in FIG. 3. The ratio h/r is usually less 3.5, less than 2 and less than 3 for base surfaces 2*a*, 2*b* having seven, eight and nine sides, respectively. Of course, the smaller the width of the strip 3, the larger the ratio h/r can be without the strip 3 ending up folded over the polygon corners.

Figure 5:
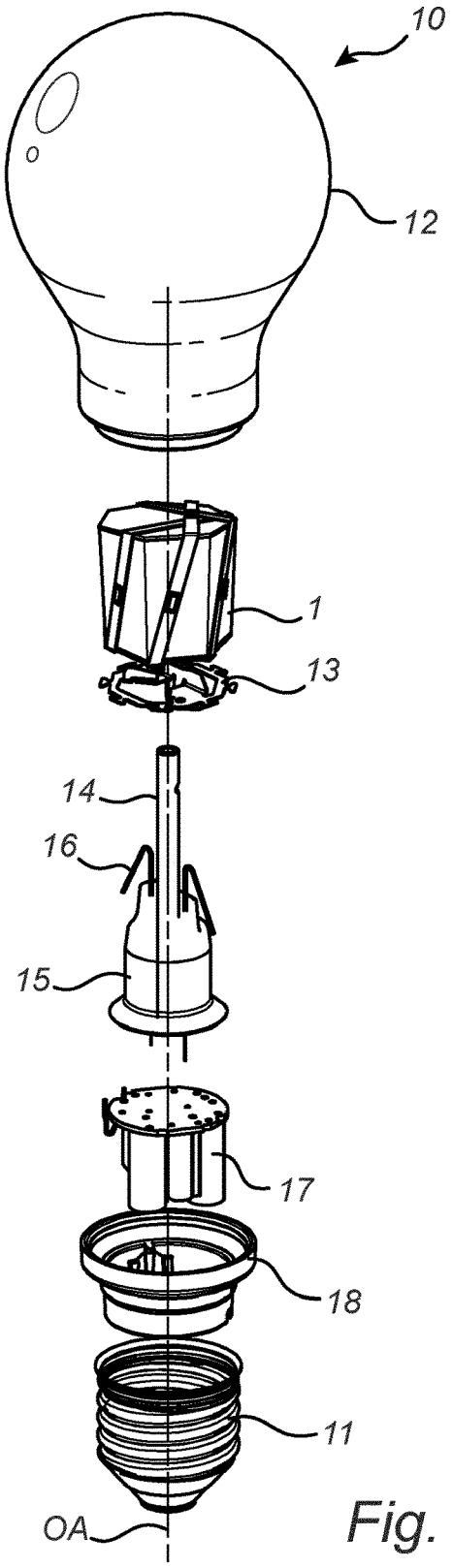
FIG. 5 is a schematic exploded view in perspective of an example of a lighting device.

FIG. 5 shows a lighting device 10 in the form of a light bulb, such as a retrofit A60 light bulb. The lighting device 10 has an optical axis OA which is a central axis of the lighting device 10. The lighting generated by the lighting device 10 is in this example substantially rotationally symmetric around the optical axis OA. A connector 11 is arranged at an end of the lighting device 10. The connector 11 is adapted to mechanically and electrically connect the lighting device 10 to a lamp socket. The connector 11 illustrated here is a screw base but may in another example be some other type of connector, such as a bayonet light bulb mount. The connector 11 is typically made of a metal. The lighting device 10 has a light transmitting housing 12 (henceforth referred to as the "housing" for brevity), the center of which is displaced along the optical axis OA relative to the connector 11. The housing 12 can for example be made of glass or plastics. The housing 12 illustrated here has a pear-like shape formed by a round head portion and a circular cylindrical neck portion, the head portion and neck portion being distal and proximate to the connector 11, respectively. Of course, the housing 12 may in other examples have a different shape, such as a cylindrical shape. In this example, the housing 12 is filled with a gas, for example helium or a mix of helium and oxygen, so the lighting device 10 is a gas filled light bulb. This may or may not be the case in other examples.

A carrier 1, similar to the one described in connection with FIG. 1, is centered on the optical axis OA inside the housing 12. The carrier 1 is centered on the optical axis OA, the optical axis OA being perpendicular to the two base surfaces 2*a*, 2*b* and parallel to the side surfaces 2*c*. The optical axis OA coincides with the first axis A of the carrier 1. In this example, the top base surface 2*a*, i.e. the base surface that is distal to the connector 11, is closed, whereas the bottom base surface 2*b*, i.e. the base surface that is proximal to the connector 11, is open. The side surfaces 2*c* are closed. There is one light source 4 by the top surface 2*a* and one light source 4 by each side surface 2*c*.

A fastener 13, sometimes referred to as a "spider", attaches the carrier 1 to an exhaust tube 14 of the lighting device 10, the exhaust tube 14 being a tube through which a gas may be introduced into the lighting device 10 during production. The exhaust tube 14 extends into the carrier 1 from below. This is possible because the strip 3 is wrapped around the cylindrical support 2 so as not to cover the centre of the base surface 2*b* that is proximal to the connector 11. The exhaust tube 14 is integrated with a stem element 15 which has a larger diameter than the exhaust tube 14 and which is sealed to the housing 12. The stem element 15 and the exhaust tube 14 are typically made of glass. Contact wires 16 are fixed to the stem element 15. The contact wires 16 protrude from the stem element 15 and electrically connect the carrier 1 to a driver 17 for powering the light sources 4 of the carrier 1. The driver 17 is in this example arranged inside the connector 11 but may be arranged inside the housing 12 in another example. An isolation element 18, which electrically isolates some parts of the driver 17 from the connector 11, is arranged between the driver 17 and the connector 11.

The lighting device 10 is put in operation by plugging the connector 11 into an electrical socket connected to an electricity supply, whereby the driver 17 supplies power to the light sources 4, via the contact wires 16 and the carrier 1, and the light sources 4 emit light that is transmitted through the envelope 12. The light source 4 on the top base surface 2*a* emit light along the optical axis OA, away from the connector 11, and the light sources 4 by the side surfaces 2*c* emit light perpendicularly to the optical axis OA.

The person skilled in the art realizes that the present invention by no means is limited to the preferred embodiments described above. On the contrary, many modifications and variations are possible within the scope of the appended claims. For example, the number of sides of the carrier 1 may be different, and the relationship between radius and height may be different than those shown. Further, other types of polygon base surfaces 2*a*, 2*b* may be contemplated, including irregular polygons. The two base surfaces 2*a*, 2*b* may also have slightly different size or shape, while still maintaining a substantially cylindrical shape.

The invention claimed is:

1. A lighting device comprising a light transmitting housing and a solid state light source carrier arranged inside the housing, characterized in that the carrier includes a cylindrical support having two polygon base surfaces and a number of side surfaces, at least a first side surface and a second side surface, and a flexible circuit strip having a plurality of solid state light sources mounted thereon, the strip being wrapped around the cylindrical support so that the strip extends at least once across each base surface, and extends at least once across each side surface and said strip extends from the first side surface to the second side surface across a base surface.

2. The lighting device according to claim 1, wherein the strip extends across each side surface only once.

3. The lighting device according to claim 2, wherein at least one solid state light source is mounted on the strip on each side surface.

4. The lighting device according to claim 1, wherein the lighting device further comprises a connector for mechanically and electrically connecting the lighting device, and wherein at least one solid state light source is mounted on the strip on a base surface facing away from the connector.

5. The lighting device according to claim 1, wherein at least one of the base surfaces is open so as to allow a flow of gas therethrough.

6. The lighting device according to claim 1, wherein the cylindrical support is one of a frame and a mesh, wherein the side surfaces and the base surfaces are open so as to allow a flow of gas therethrough.

7. The lighting device according to claim 1, wherein the number of side surfaces is seven, and wherein a ratio between a height of the cylindrical support to a radius of the base surfaces is less than 3.5.

8. The lighting device according to claim 1, wherein the number of side surfaces is eight, and wherein a ratio between a height of the cylindrical support to a radius of the base surfaces is less than 2.

9. The lighting device according to claim 1, wherein the number of side surfaces is nine, and wherein a ratio between a height of the cylindrical support to a radius of the base surfaces is less than 3.

* * * * *